US005370162A

United States Patent [19]

Lewis

[11] Patent Number: 5,370,162

[45] Date of Patent: Dec. 6, 1994

[54] CONTAINER FILLER

[75] Inventor: Dennis M. Lewis, South Haven, Mich.

[73] Assignee: BEI Incorporated, South Haven, Mich.

[21] Appl. No.: 67,645

[22] Filed: May 24, 1993

[51] Int. Cl.[5] ..... B65B 43/42; B67C 3/00

[52] U.S. Cl. ..... 141/167; 141/169; 198/461

[58] Field of Search ..... 141/163, 167, 168, 169, 141/180, 131, 132; 198/461, 575, 579

[56] References Cited

U.S. PATENT DOCUMENTS

| | | | |
|---|---|---|---|
| 2,015,187 | 9/1935 | Mayer | 198/459 |
| 2,604,971 | 7/1952 | Snyder et al. | 198/462 |
| 3,403,772 | 10/1968 | Vadas | 198/462 |
| 3,587,674 | 6/1971 | Adkin | 141/237 |
| 3,665,863 | 5/1972 | Patin | 198/579 |
| 3,773,317 | 11/1973 | Kummerer | 271/34 |
| 3,911,800 | 10/1975 | Feldkamper | 93/93 |
| 4,038,807 | 8/1977 | Beardsley et al. | 53/282 |
| 4,095,721 | 6/1978 | Patzlaff et al. | 221/210 |
| 4,197,935 | 4/1980 | Aterianus et al. | 198/460 |
| 4,658,566 | 4/1987 | Sanfilippo | 53/432 |
| 4,905,454 | 3/1990 | Sanfilippo et al. | 53/432 |
| 5,038,915 | 8/1991 | Delsanto | 198/419.3 |
| 5,097,939 | 3/1992 | Shanklin et al. | 198/419.2 |
| 5,137,139 | 8/1992 | Ruscello | 198/461 |

*Primary Examiner*—Henry J. Recla
*Assistant Examiner*—Steven O. Douglas
*Attorney, Agent, or Firm*—Price, Heneveld, Cooper, DeWitt & Litton

[57] ABSTRACT

A container filler assembly, as for berries, having a filler hopper located above a central filler conveyor driven at a slower speed than an upstream denesting and infeed conveyor which feeds empty containers to the filler conveyor, and an exit conveyor downstream of the filler conveyor driven at a greater speed than the filler conveyor, such that spaced containers on the denesting conveyor are put into abutment as they approach the filler hopper outlet, and subsequently placed again in a spaced condition after filling for dropping any berries caught on the container rims and for being closed as by placement of a wrapper on the filled container or closure of the clamshell container. The conveyors have overlapping driven V-belts with high friction surfaces.

The denesting conveyor is preferably directly driven by a motor, while the filler conveyor and the exit conveyor are driven through a controlled clutch from the same motor. The clutch is controlled by two container sensors, one being a container sensor such as an electric eye at the denesting conveyor, to stop the filler conveyor and the exit conveyor if adequate containers are not sensed on the infeed denester conveyor, and a second container sensor at the discharge end of the exit conveyor and actuated by a container left in front of the sensor more than a certain preselected time period, to stop the filler conveyor and exit conveyor for preventing the high friction conveyor from tipping the containers over and jamming the system.

3 Claims, 1 Drawing Sheet

CONTAINER FILLER

BACKGROUND OF THE INVENTION

This invention relates to a container filling apparatus, particularly for filling pint and/or quart containers with flowable, discreet, small, solid items such as berries.

Known berry filling apparatus typically is like that set forth in U.S. Pat. Nos. 4,038,807 and 4,095,721, for example. Specifically, the containers such as quart or pint-size containers are advanced on a belt while each is sequentially filled with berries from a fill hopper, and then subsequently closed as by a wrapper placed over the top and secured to the container. Such equipment has functioned well, but has certain limitations. One significant limitation was that the filler had to be modified to accommodate berry containers, e.g., pints, of different dimensions. Another limitation was the inability to effectively handle clamshell-type containers.

Moreover, to restrain each container being filled with the prior fillers, a stop mechanism was projected into the path of the container to stop it on the moving belt to fill it, and then subsequently release it. Actually, it is desirable to use a high friction surface material on the belt, such as "Linatex" brand surface, which is a rubber-type material manufactured by The Linatex Corporation, Stafford Springs, Conn., to assure that the empty cartons are advanced rather than simply slip on the belt. This is particularly true for very lightweight, plastic clamshell type containers. However, stopping of the container when it is being filled causes the high friction moving belt to tend to advance the container bottom and tip the container over. Furthermore, since the sequentially stopped containers come into abutment under the filler hopper, they must be subsequently separated for the wrapper to be applied around the container. Or, if the container is a clamshell-type, the cover portion must be flipped over about the integral hinge secured to the base portion.

SUMMARY OF THE INVENTION

This invention relates to a container filler assembly, as for berries, having a filler hopper located above a central filler conveyor that is driven at a slower speed than an upstream denesting and infeed conveyor which feeds empty containers to the filler conveyor, and an exit conveyor downstream of the filler conveyor and driven at a greater speed than the filler conveyor, such that spaced containers on the denesting conveyor are put into abutment as they approach the filler hopper outlet, and subsequently placed again in a spaced condition after filling, for the purpose of dropping any berries caught on the container rims as into an underlying container, and for being closed as by placement of a wrapper on the filled container or closure of the clamshell container.

The denesting conveyor is preferably directly driven by a motor, while the filler conveyor and the exit conveyor are driven through a controlled clutch from the same motor. The clutch is controlled by two container sensors, one being a container sensor such as an electric eye at the denesting conveyor, to stop the filler conveyor and the exit conveyor if adequate containers are not sensed on the infeed denester conveyor, and a second container sensor at the discharge end of the exit conveyor and actuated by a container left in front of the sensor more than a certain preselected time period, to stop the filler conveyor and exit conveyor for preventing the high friction conveyor from tipping the containers over and jamming the system.

The novel apparatus works effectively for open top containers and for clamshell style containers. It is effective for containers of different dimensions. Thus it is in effect a universal filler. The apparatus can be manufactured at a cost which is only a fraction of that for presently manufactured filler apparatuses.

These and other objects, advantages and features of the invention will become apparent to those in the art upon studying the following specification in conjunction with the drawings.

DESCRIPTION OF THE PREFERRED EMBODIMENT

Figure 1:
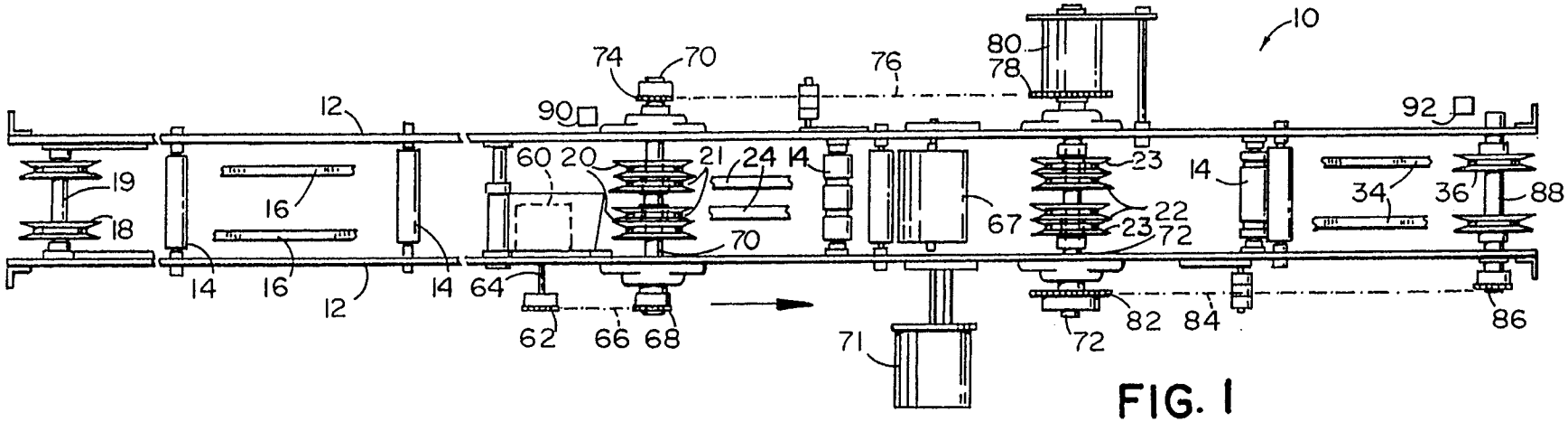
FIG. 1 is an elevational view of the apparatus of this invention.
Figure 2:
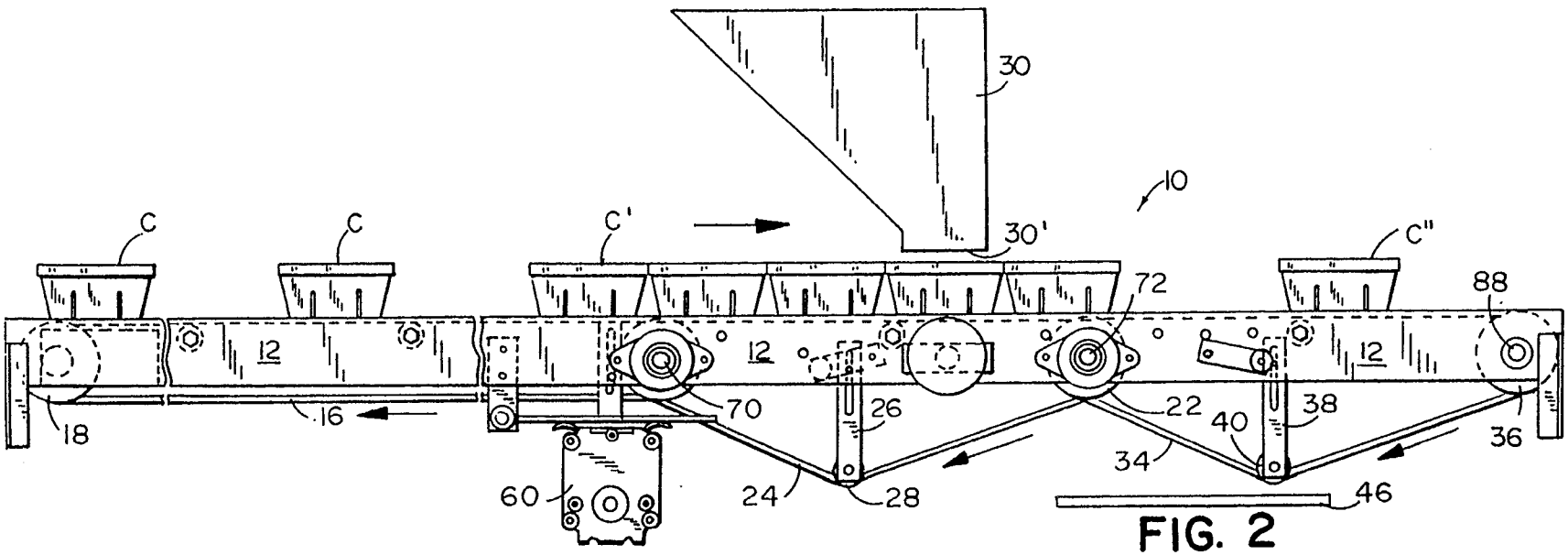
FIG. 2 is a plan view thereof, with portions of the conveyor belts removed for observation of the underlying components.

Referring now specifically to the drawings, the complete apparatus 10 there depicted includes a pair of elongated, spaced, parallel conveyor supports or rails 12 having rotationally suspended therebetween a plurality of transverse, spaced rollers 14 for supporting three pairs of conveyor belts, specifically, first conveyor V-belts 16 extending around a first pair of pulleys 18 on shaft 19 at the infeed end, and second and third pairs of pulleys 20 and 21 on shaft 70 at the discharge end of the first conveyor. The belts comprising the first conveyor recirculate to receive denested containers C dropped in spaced fashion thereon as illustrated in the left part of FIG. 2. Belts 16 engage the grooves of pulleys 18 and engage the outer pair of pulleys 20 which drive the belts. The inner pair of pulleys 21 free wheel on shaft 70. A second pair of recirculating belts 24, comprising the second conveyor downstream of belts 16, rest upon rollers 14 and travel around inner pulleys 21 at the infeed end thereof, as well as around the inner pair of pulleys 22 on shaft 72 at the discharge end of the conveyor. This second conveyor forms a filler conveyor as will be described hereinafter. Inner pulleys 22 are driven by shaft 72, while the outer pair of pulleys 23 free wheel on shaft 72.

Positioned above this second conveyor is a filler hopper 30 having an outlet 30' at the bottom thereof, oriented toward belts 24 and therefore toward containers C' in abutment with each other on belts 24. Beneath belts 24 is a conventional, rotational vibrator drum 67 driven by an eccentric rotating shaft 69 from motor 71 mounted to rail 12.

Downstream of the second conveyor is a third conveyor which is comprised of recirculating V-belts 34 which travel around the outer pair of pulleys 23 at the infeed end and a pair of pulleys 36 at the discharge end, pulleys 36 being mounted on and driven by shaft 88. Beneath the third conveyor is a support 46 for a lug-type container or the like (not shown) for purposes to be explained hereinafter.

An adjustable belt tightener 26 extends between the supports 12 and an idler pulley 28 at the bottom thereof to engage belt 24. A belt tightener 38 extends between frame elements 12 and the lower end pulley 40, engaging belt 34.

The first infeed conveyor is driven directly by motor 60 which has an output sprocket 62 on its output shaft 64, aligned with a driven sprocket 68 on shaft 70 to which double pulleys 20 are mounted. A chain 66 extends around sprockets 62 and 68. The outer pulleys 20 are keyed to and driven by shaft 70 to drive conveyor 16 directly. The inner pulleys 21 are free to rotate about shaft 70, with the second conveyor being driven by the inner pulleys 22 while the outer pulleys 23 are free to rotate on shaft 72.

The end of shaft 70 opposite sprocket 68 includes a second drive sprocket 74 which propels a roller chain 76 that also extends around a sprocket 78 on a clutch 80. Preferably this is a conventional, solenoid-actuated, wrap spring clutch and stop mounted to rail 12. Clutch 80 is mounted on the end of shaft 72 which supports the set of double pulleys 22. On the opposite end of shaft 72 from sprocket 78 is another sprocket 82 which is connected by roller chain 84 to sprocket 86. Sprocket 86 is on the end of shaft 88 on which pulleys 36 are mounted. Clutch 80 is controlled in response to a container sensor 90 at the discharge end of the infeed conveyor, and by a second container sensor 92 at the discharge end of the exit conveyor. These sensors may be conventional electric eye devices or the equivalent, electrically connected through internal timers to clutch 80 to actuate it as necessary.

The drive arrangement enables the infeed conveyor to be constantly driven by motor 60, while the second filling conveyor and the third exit conveyor can be actuated or deactuated, utilizing clutch 80, under certain conditions to be described. Specifically, if sensor 90 does not detect adequate spaced containers C on the infeed conveyor for the filling operation, i.e., by sensing successive empty containers within a predetermined preset time interval, it will actuate the clutch solenoid to shift clutch 80 which deactuates the drive pulleys 22 and 36. Likewise, if sensor 92 detects the presence of a filled container on the discharge end for too long a period of time, i.e., greater than a preset time period, it will deactuate the second filling conveyor and the third exit conveyor until the sensed container is removed from the third exit conveyor. Because the conveyor belts are coated with a high friction material, any tendency of the belts to forcefully move under and tip over a stalled container is prevented by stopping the exit conveyor. The significance of the first sensor 90, which detects too large a spacing between containers C on the infeed conveyor and shuts down the filler conveyor and the exit conveyor, is to prevent the filling operation from occurring when no container is beneath hopper outlet 30'.

This apparatus has been found to be effective for open top, coverless, paper or wood containers of various dimensions, typically used for products such as berries, and which are subsequently wrapped with a flexible wrapper to close them, and for the more recent clamshell-type, thin plastic container which has an integral hinge and cover to be pivotally shifted to cover the container when full.

During operation of the novel apparatus, empty containers C are denested from a stack (not shown) of nested containers in a conventional manner to be dropped one at a time at spaced intervals on the infeed conveyor. This conveyor moves at a relatively rapid speed compared to the subsequent filling conveyor. As the containers are transferred to and advanced onto the second, slowly moving filling conveyor, the containers move into abutment with each other as shown by containers C' in FIG. 2. The hopper outlet 30' continuously discharges the berries into the containers to fill them. Some berries tend to hang up on the rims between the containers. As the filled containers are subsequently discharged onto the more rapidly moving exit conveyor, they are immediately pulled into spaced relationship. In so doing, the berries which were caught on the rims between adjacent containers drop into a lug or other suitable receptacle on support 46. The filled, spaced containers C" can then be wrapped, or can be covered by pivotally closing the clamshell cover. If the filler conveyor and the exit conveyor are stopped, overfilling of the container is prevented simply by having the hopper beneath the hopper outlet 30' a controlled distance above the container.

The apparatus has been found to be relatively less expensive to build and highly effective in its operation. Various additional advantages and features of the novel apparatus shown in its preferred embodiment will be apparent to those in this field of endeavor upon studying the foregoing disclosure. Hence, the invention is not intended to be limited to the preferred embodiment set forth as exemplary, but only by the scope of the appended claims and the reasonably equivalent structures to those set forth therein.

The embodiments of the invention in which an exclusive property or privilege is claimed are defined as follows.

What is claimed is:

1. Apparatus for sequentially filling containers having an open top and a peripheral rim, with flowable, solid product, comprising:

a first container-advancing conveyor having a first drive thereto for advancing spaced, empty containers;

a second container-advancing conveyor downstream of said first conveyor and positioned to receive containers from said first conveyor, and having a second drive thereto;

a container filler hopper above said second conveyor, having an outlet toward said second conveyor;

a third container-advancing conveyor downstream of said second conveyor, positioned to receive containers from said second conveyor, and having a third drive thereto;

means for causing said second drive to operate said second conveyor at a sufficiently slower speed than the speed of said first conveyor to cause containers on said second conveyor to move into abutment with each other upon receipt of spaced containers from said first conveyor, to be filled with product from said hopper with incidental collection of product between the rims of the containers, and said third drive to operate said third conveyor at a speed greater than that of said second conveyor to cause said third conveyor to spread apart filled containers upon receipt from said second conveyor for causing product at the rims of the containers to fall, and to allow package closure;

said first drive including a motor and drive connection from said motor to said first conveyor;

a clutch drive connection to said second and third conveyors;

a first container sensor adjacent said first conveyor and associated with said clutch drive connection to stop said second and third conveyors when containers on said first conveyor are spaced apart more than a predetermined amount; and a second container sensor adjacent the discharge end of said third conveyor and associated with said clutch drive connection to stop said second and third conveyors when said second sensor detects a container for more than a predetermined period of time.

2. Apparatus for sequentially filling containers having an open top and a peripheral rim, with flowable, solid product, comprising:

a first container-advancing conveyor having a first drive thereto for advancing spaced, empty containers;

a second container-advancing conveyor downstream of said first conveyor and positioned to receive containers from said first conveyor, and having a second drive thereto;

a container filler hopper above said second conveyor, having an outlet toward said second conveyor;

a third container-advancing conveyor downstream of said second conveyor positioned to receive containers from said second conveyor, and having a third drive thereto:

means for causing said second drive to operate said second conveyor at a sufficiently slower speed than the speed of said first conveyor to cause containers on said second conveyor to move into abutment with each Other upon receipt of spaced containers from said first conveyor, to be filled with product from said hopper with incidental collection of product between the rims of the containers, and said third drive to operate said third conveyor at a speed greater than that of said second conveyor to cause said third conveyor to spread apart filled containers upon receipt from said second conveyor for causing product at the rims of the containers to fall, and to allow package closure;

said first conveyor comprising a first pair of V-belts, a first shaft having a first pair of pulleys at the infeed end of said first conveyor, a second shaft having a second pair of pulleys at the outfeed end of said first conveyor;

said second conveyor comprising a second pair of V-belts, a third pair of pulleys on said second shaft at the infeed end of said second conveyor, and a third shaft having a fourth pair of pulleys at the outfeed end of said second conveyor;

said third conveyor comprising a third pair of V-belts, a fifth pair of pulleys on said third shaft at the infeed end of said third conveyor, and a fourth shaft having a sixth pair of pulleys at the outfeed end of said third conveyor;

said first and second pairs of V-belts overlapping each other, and said second and third pairs of V-belts overlapping each other, for smooth transfer of containers from said first conveyor to said second conveyor and from said second conveyor to said third conveyor.

3. The apparatus in claim 2 wherein said conveyors have high friction surfaces, and including a second container sensor adjacent the discharge end of said third conveyor and associated with said clutch drive connection to stop said second and third conveyors when said second sensor detects a container for more than a predetermined period of time.

* * * * *